US005836248A

United States Patent [19]

Jarrold et al.

[11] Patent Number: 5,836,248

[45] Date of Patent: Nov. 17, 1998

[54] ZIRCONIA-ALUMINA COMPOSITE CERAMIC LITHOGRAPHIC PRINTING MEMBER

[75] Inventors: Gregory S. Jarrold, Henrietta; Dilip K. Chatterjee; Syamal K. Ghosh, both of Rochester, all of N.Y.

[73] Assignee: Eastman Kodak Company, Rochester, N.Y.

[21] Appl. No.: 850,315

[22] Filed: May 1, 1997

[51] Int. Cl.[6] ..... B41N 1/14

[52] U.S. Cl. ..... 101/453; 101/465

[58] Field of Search ..... 101/453, 454, 101/456, 458, 459, 463.1, 465–467, 478; 430/302

[56] References Cited

U.S. PATENT DOCUMENTS

| | | | |
|---|---|---|---|
| 3,506,779 | 4/1970 | Brown et al. | 101/467 |
| 3,549,733 | 12/1970 | Caddell | 101/401.1 |
| 3,574,657 | 4/1971 | Burnett | 101/465 |
| 3,654,864 | 4/1972 | Ovshinsky | 101/467 |
| 3,793,033 | 2/1974 | Mukherjee | 101/456 |
| 3,832,948 | 9/1974 | Barker | 101/401.1 |
| 3,945,318 | 3/1976 | Landsman | 101/467 |
| 3,962,513 | 6/1976 | Eames | 101/463.1 |
| 3,964,389 | 6/1976 | Peterson | 101/467 |
| 3,975,197 | 8/1976 | Mikelsons | 101/457 |
| 4,034,183 | 7/1977 | Uhlig | 219/121.85 |
| 4,054,094 | 10/1977 | Caddell et al. | 101/467 |
| 4,081,572 | 3/1978 | Pacansky | 101/467 |
| 4,334,006 | 6/1982 | Kitajima et al. | 430/254 |
| 4,687,729 | 8/1987 | Cadwell et al. | 101/463.1 |
| 4,693,958 | 9/1987 | Schwartz et al. | 430/302 |
| 4,731,317 | 3/1988 | Fromson et al. | 430/159 |
| 4,794,680 | 1/1989 | Meyerhoff et al. | 492/54 |
| 4,846,065 | 7/1989 | Mayrhofer et al. | 101/453 |
| 4,967,663 | 11/1990 | Metcalf | 101/348 |
| 5,045,697 | 9/1991 | Schneider | 250/316.1 |
| 5,238,778 | 8/1993 | Hirai et al. | 101/467 |
| 5,272,120 | 12/1993 | Kosuda et al. | 501/105 |
| 5,293,817 | 3/1994 | Nussel et al. | 101/453 |
| 5,317,970 | 6/1994 | Nussel et al. | 101/478 |
| 5,345,869 | 9/1994 | Treverton et al. | 101/454 |
| 5,353,705 | 10/1994 | Lewis et al. | 101/453 |
| 5,378,580 | 1/1995 | Leenders | 430/303 |
| 5,385,092 | 1/1995 | Lewis et al. | 101/467 |
| 5,395,729 | 3/1995 | Reardon et al. | 430/200 |
| 5,454,318 | 10/1995 | Hirt et al. | 101/478 |
| 5,464,724 | 11/1995 | Akiyama et al. | 101/459 |
| 5,543,269 | 8/1996 | Chatterjee et al. | 430/346 |
| 5,555,809 | 9/1996 | Hirt et al. | 101/478 |
| 5,713,287 | 2/1998 | Gelbart | 101/467 |

FOREIGN PATENT DOCUMENTS

| | | |
|---|---|---|
| 0 001 068 | 3/1979 | European Pat. Off. . |
| 0 531 878 | 3/1993 | European Pat. Off. . |
| 0 573 091 | 12/1993 | European Pat. Off. . |
| 0 693 371 | 1/1996 | European Pat. Off. . |
| 44 42 235 | 6/1995 | Germany . |

*Primary Examiner*—Stephen R. Funk
*Attorney, Agent, or Firm*—J. Lanny Tucker

[57] ABSTRACT

Long wearing and reusable lithographic printing members are prepared from a ceramic that is a composite of a zirconia alloy and α-alumina. In use, a surface of the zirconia-alumina composite ceramic printing member is imagewise exposed to electromagnetic radiation which transforms it from a hydrophilic to an oleophilic state or from an oleophilic to a hydrophilic state, thereby creating a lithographic printing surface which is hydrophilic in non-image areas and is oleophilic and thus capable of accepting printing ink in image areas. Such inked areas can then be used to transfer an image to a suitable substrate in lithographic printing. These printing members are directly laser-imageable as well as image erasable.

17 Claims, 3 Drawing Sheets

FIG. 1
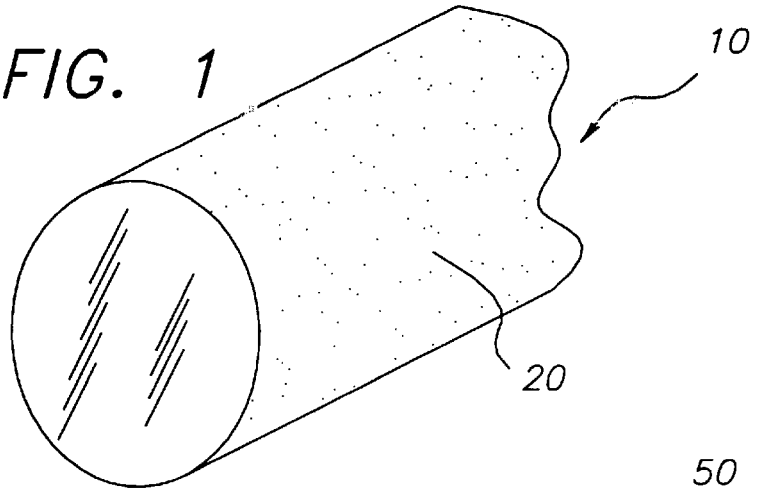
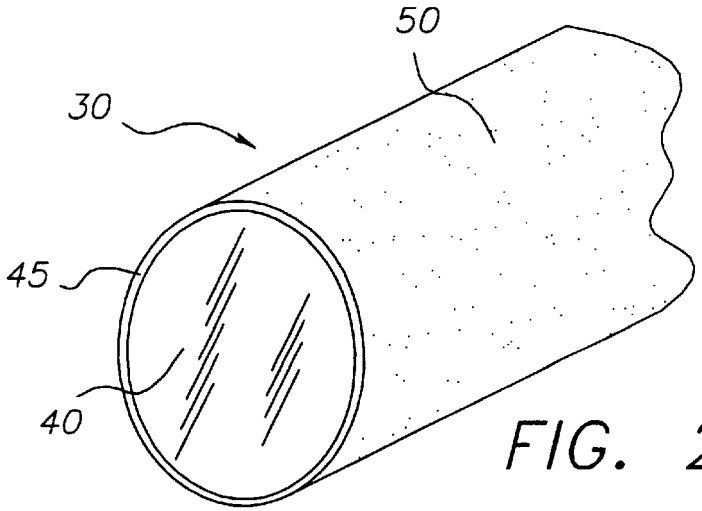
FIG. 2
FIG. 3
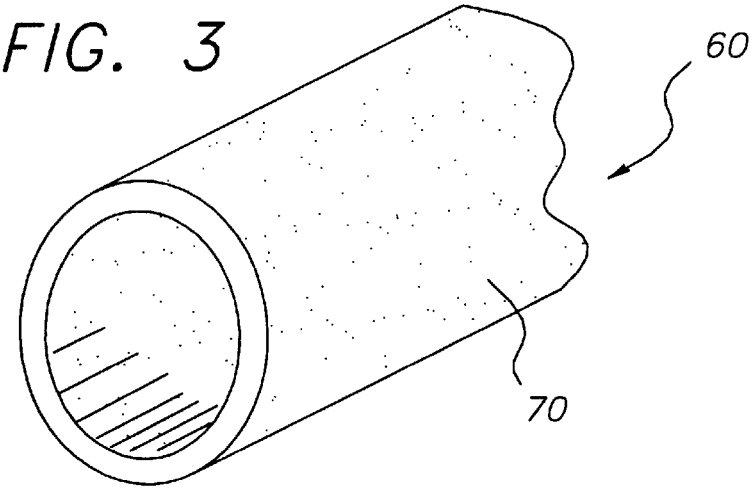

ZIRCONIA-ALUMINA COMPOSITE CERAMIC LITHOGRAPHIC PRINTING MEMBER

RELEVANT APPLICATIONS

Copending and commonly assigned U.S. Ser. No. 08/576,178, filed Dec. 21, 1995, by Ghosh et al, now U.S. Pat. No. 5,743,188, based on Provisional application 60/005,729, filed Oct. 20, 1995.

Copending and commonly assigned U.S. Ser No. 08/844,348, filed on Apr. 18, 1997 by Chatterjee, Ghosh and N üssel, as a CIP of U.S. Ser. No. 08/576,178, noted above, and entitled "Zirconia Alloy Cylinders and Sleeves for Imaging and Lithographic Printing Methods".

Copending and commonly assigned U.S. Ser. No. 08/844,292, filed on Apr. 18, 1997 by Chatterjee and Ghosh, and entitled "Flexible Zirconia Alloy Ceramic Lithographic Printing Tape and Methods of Using Same."

Copending and commonly assigned U.S. Ser. No. 08/843,522, filed on Apr. 18, 1997 by Chatterjee, Ghosh and Korn, and entitled "Method of Controlled Laser Imaging of Zirconia Alloy Ceramic Lithographic Member to Provide Localized Melting in Exposed Areas".

Copending and commonly assigned U.S. Ser. No. 08/848,780, filed on even date herewith by Ghosh and Chatterjee, and entitled "Method of Controlled Laser Imaging of Zirconia-Alumina Composite Ceramic Lithographic Printing Member to Provide Localized Melting in Exposed Areas".

Copending and commonly assigned U.S. Ser. No. 08/848,332, filed on even date herewith by Chatterjee and Ghosh, and entitled "Laser Ablation Imaging of Zirconia-Alumina Composite Ceramic Printing Member".

FIELD OF THE INVENTION

This invention relates in general to lithography and in particular to new and improved lithographic printing members. More specifically, this invention relates to novel printing members having a printing surface composed of a zirconia-alumina composite ceramic, that are readily imaged and then useful for lithographic printing.

BACKGROUND OF THE INVENTION

The art of lithographic printing is based upon the immiscibility of oil and water, wherein the oily material or ink is preferentially retained by the image area and the water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced, such as paper, cloth and the like. Commonly the ink is transferred to an intermediate material called the blanket, which in turn transfers the ink to the surface of the material upon which the image is to be reproduced.

Aluminum has been used for many years as a support for lithographic printing plates. In order to prepare the aluminum for such use, it is typical to subject it to both a graining process and a subsequent anodizing process. The graining process serves to improve the adhesion of the subsequently applied radiation-sensitive coating and to enhance the water-receptive characteristics of the background areas of the printing plate. The graining affects both the performance and the durability of the printing plate, and the quality of the graining is a critical factor determining the overall quality of the printing plate. A fine, uniform grain that is free of pits is essential to provide the highest quality performance.

Both mechanical and electrolytic graining processes are well known and widely used in the manufacture of lithographic printing plates. Optimum results are usually achieved through the use of electrolytic graining, which is also referred to in the art as electrochemical graining or electrochemical roughening, and there have been a great many different processes of electrolytic graining proposed for use in lithographic printing plate manufacturing. Processes of electrolytic graining are described in numerous references.

In the manufacture of lithographic printing plates, the graining process is typically followed by an anodizing process, utilizing an acid such as sulfuric or phosphoric acid, and the anodizing process is typically followed by a process that renders the surface hydrophilic such as a process of thermal silication or electrosilication. The anodization step serves to provide an anodic oxide layer and is preferably controlled to create a layer of at least 0.3 $g/m^2$. Processes for anodizing aluminum to form an anodic oxide coating and then hydrophilizing the anodized surface by techniques such as silication are very well known in the art, and need not be further described herein.

Illustrative of the many materials useful in forming hydrophilic barrier layers are polyvinyl phosphonic acid, polyacrylic acid, polyacrylamide, silicates, zirconates and titanates.

The result of subjecting aluminum to an anodization process is to form an oxide layer that is porous. Pore size can vary widely, depending on the conditions used in the anodization process, but is typically in the range of from about 0.1 to about 10 $\mu$m. The use of a hydrophilic barrier layer is optional but preferred. Whether or not a barrier layer is employed, the aluminum support is characterized by having a porous wear-resistant hydrophilic surface that specifically adapts it for use in lithographic printing, particularly in situations where long press runs are required.

A wide variety of radiation-sensitive materials suitable for forming images for use in the lithographic printing process are known. Any radiation-sensitive layer is suitable which, after exposure and any necessary developing and/or fixing, provides an area in imagewise distribution that can be used for printing.

Useful negative-working compositions include those containing diazo resins, photocrosslinkable polymers and photopolymerizable compositions. Useful positive-working compositions include aromatic diazooxide compounds such as benzoquinone diazides and naphthoquinone diazides.

Lithographic printing plates of the type described hereinabove are usually developed with a developing solution after being imagewise exposed. The developing solution, which is used to remove the non-image areas of the imaging layer and thereby reveal the underlying porous hydrophilic support, is typically an aqueous alkaline solution and frequently includes a substantial amount of organic solvent. The need to use and dispose of substantial quantities of alkaline developing solution has long been a matter of considerable concern in the printing art.

Efforts have been made for many years to manufacture a printing plate that does not require development with an alkaline developing solution. Examples of the many references relating to such prior efforts include, among others: U.S. Pat. No. 3,506,779 (Brown et al), U.S. Pat. No.

3,549,733 (Caddell), U.S. Pat. No. 3,574,657 (Burnett), U.S. Pat. No. 3,793,033 (Mukherjee), U.S. Pat. No. 3,832,948 (Barker), U.S. Pat. No. 3,945,318 (Landsman), U.S. Pat. No. 3,962,513 (Eames), U.S. Pat. No. 3,964,389 (Peterson), U.S. Pat. No. 4,034,183 (Uhlig), U.S. Pat. No. 4,054,094 (Caddell et al), U.S. Pat. No. 4,081,572 (Pacansky), U.S. Pat. No. 4,334,006 (Kitajima et al), U.S. Pat. No. 4,693,958 (Schwartz et al), U.S. Pat. No. 4,731,317 (Fromson et al), U.S. Pat. No. 5,238,778 (Hirai et al), U.S. Pat. No. 5,353,705 (Lewis et al), U.S. Pat. No. 5,385,092 (Lewis et al), U.S. Pat. No. 5,395,729 (Reardon et al), EP-A-0 001 068, and EP-A-0 573 091.

Lithographic printing plates designed to eliminate the need for a developing solution which have been proposed heretofore have suffered from one or more disadvantages that have limited their usefulness. For example, they have lacked a sufficient degree of discrimination between oleophilic image areas and hydrophilic non-image areas with the result that image quality on printing is poor, or they have had oleophilic image areas which are not sufficiently durable to permit long printing runs, or they have had hydrophilic non-image areas that are easily scratched and worn, or they have been unduly complex and costly by virtue of the need to coat multiple layers on the support.

The lithographic printing plates described hereinabove are printing plates which are employed in a process that employs both a printing ink and an aqueous fountain solution. Also well known in the lithographic printing art are so-called "waterless" printing plates that do not require the use of a fountain solution. Such plates have a lithographic printing surface comprised of oleophilic (ink-accepting) image areas and oleophobic (ink-repellent) background areas. They are typically comprised of a support, such as aluminum, a photosensitive layer that overlies the support, and an oleophobic silicone rubber layer that overlies the photosensitive layer, and are subjected to the steps of imagewise exposure followed by development to form the lithographic printing surface.

Ceramic printing members, including printing cylinders are known. U.S. Pat. No. 5,293,817 (Nüssel et al), for example, describes porous ceramic printing cylinders having a printing surface prepared from zirconium oxide, aluminum oxide, aluminum-magnesium silicate, magnesium silicate or silicon carbide.

It has also been discovered that ceramic alloys of zirconium oxide and a secondary oxide that is MgO, CaO, $Y_2O_3$, $Sc_2O_3$ or a rare earth oxide are highly useful printing members, as described for example, in copending U.S. Ser. No. 08/576,178 (noted above) now U.S. Pat. No. 5,743,188.

While such printing members are highly useful with a number of advantages over conventional materials, there is a need to provide ceramic printing members having greater strength, fracture resistance and wearability, and that are more lightweight.

SUMMARY OF THE INVENTION

In accordance with this invention, a lithographic printing member has a printing surface composed of a ceramic that is a composite of: (1) a zirconia alloy, and (2) alumina, the ceramic composite having a density of from about 5.0 to about 6.05 g/cm$^3$, and from about 0.1 to about 50%, by weight being comprised of alumina.

The printing members of this invention have a number of advantages. For example, no chemical processing is required so that the effort, expense and environmental concerns associated with the use of aqueous alkaline developing solutions are avoided. Post-exposure baking or blanket exposure to ultraviolet or visible light sources, as are commonly employed with many lithographic printing plates, are not required. Imagewise exposure of the printing member can be carried out directly with a focused laser beam that converts the ceramic printing surface from a hydrophilic to an oleophilic state or from an oleophilic to a hydrophilic state. Exposure with a laser beam enables the printing member to be imaged directly from digital data, and used in printing, without the need for intermediate films and conventional time-consuming optical printing methods. Since no chemical processing, wiping, brushing, baking or treatment of any kind is required, it is feasible to expose the printing member directly on the printing press by equipping the press with a laser exposing device and suitable means for controlling the position of the laser exposing device.

A still further advantage is that the printing member is well adapted to function with conventional fountain solutions and conventional lithographic printing inks so that no novel or costly chemical compositions are required. The printing members of this invention are also designed to be "erasable" as described below. That is, the images can be erased and the printing members reused.

The zirconia-alumina composite ceramic utilized in this invention has many characteristics that render it especially beneficial for use in lithographic printing. Thus, for example, the ceramic surface is extremely durable, abrasion-resistant, and long wearing. Lithographic printing members having such a printing surface are capable of producing a virtually unlimited number of copies, for example, press runs of up to several million. On the other hand, since very little effort is required to prepare the printing member for printing, it is also well suited for use in very short press runs for the same or different images. Discrimination between oleophilic image areas and hydrophilic non-image areas is excellent. The printing member can be of several different forms (described below) and thus can be flexible, semi-rigid or rigid. Its use is fast and easy to carry out, image resolution is very high and imaging is especially well suited to images that are electronically captured and digitally stored.

The lithographic printing members of this invention exhibit exceptional long-wearing characteristics that greatly exceed those of the conventional grained and anodized aluminum printing plates. In addition, they have greater wearability and higher strength and fracture resistance (or toughness) over other ceramic printing members, including those having printing surfaces prepared solely from zirconia or zirconia-secondary oxide alloys as described above.

A further advantage of the printing members of this invention is that the zirconia-alumina composite is lighter (less dense) than the zirconia alloys described in prior applications because of the lower density of the alumina included therein. Moreover, the alumina has a lower surface energy and melting point so that image discrimination is better, and imaging can be carried out at lower temperatures. Still further, because the ceramic contains alumina, porosity is more readily controlled during manufacture.

Still another advantage of lithographic printing members prepared from zirconia-alumina composite ceramics as described herein is that, unlike conventional lithographic printing plates, they are erasable and reusable. Thus, for example, after the printing ink has been removed from the printing surface using known devices and procedures, the oleophilic image areas of the printing surface can be erased by thermally-activated oxidation or by laser-assisted oxidation. Accordingly, the printing member can be imaged, erased and re-imaged repeatedly.

The use of zirconia-alumina composite ceramics as directly laser-imageable, erasable printing members in "direct-to-plate" applications has not been heretofore disclosed, and represents an important advance in the lithographic printing art.

BRIEF DESCRIPTION OF THE DRAWINGS

FIG. 1 is a highly schematic fragmentary isometric view of a printing cylinder of this invention, that is composed entirely of a zirconia-alumina composite ceramic.

FIG. 2 is a highly schematic fragmentary isometric view of a printing member that is composed of a non-ceramic core and a zirconia-alumina composite ceramic layer or sleeve.

FIG. 3 is a highly schematic fragmentary isometric view of a hollow zirconia-alumina composite ceramic sleeve of this invention.

DETAILED DESCRIPTION OF THE INVENTION

Figure 4:
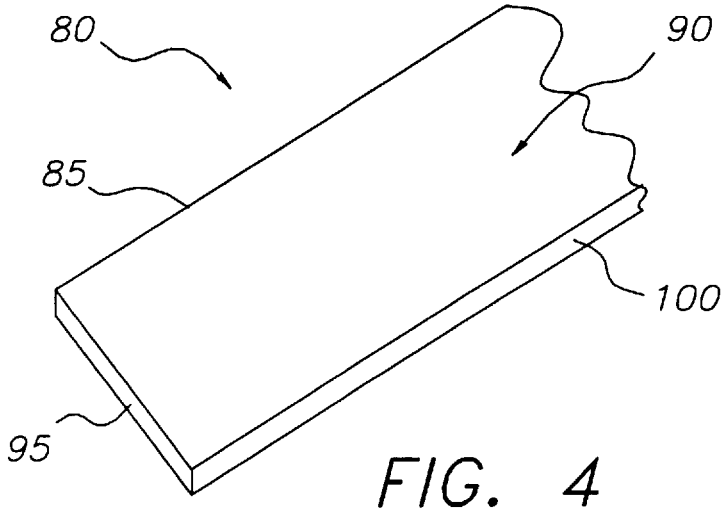
FIG. 4 is a highly schematic isometric partial view of a printing tape of this invention that is composed entirely of a web of a zirconia-alumina composite ceramic.

A zirconia-alumina composite ceramic composed predominantly of zirconia of stoichiometric composition is hydrophilic. Transforming the zirconia from a stoichiometric composition to a substoichiometric composition changes the ceramic from hydrophilic to oleophilic. Thus, in one embodiment of this invention, the lithographic printing member comprises a hydrophilic zirconia-alumina composite ceramic of stoichiometric composition, and imagewise exposure (with electromagnetic irradiation) converts it to an oleophilic substoichiometric composition in the exposed regions (image areas), leaving non-exposed (background) areas hydrophilic.

In an alternative embodiment of the invention, the lithographic printing member comprises an oleophilic zirconia-alumina composite ceramic of substoichiometric composition, and imagewise exposure (with electromagnetic irradiation, usually with either visible or infrared irradiation) converts it to a hydrophilic stoichiometric composition in the exposed regions. In this instance, the exposed regions serve as the background (or non-image areas) and the unexposed regions serve as the image areas.

The hydrophilic zirconia-alumina composite ceramic thus comprises the stoichiometric oxide, $ZrO_2$, while the oleophilic zirconia-alumina composite ceramic comprises a substoichiometric oxide, $ZrO_{2-x}$. The change from a stoichiometric to a substoichiometric composition is achieved by reduction while the change from a substoichiometric composition to a stoichiometric composition is achieved by oxidation.

The lithographic printing member is comprised entirely of, or has at least a printing surface comprised of, a composite (or mixture) of: (1) an alloy of zirconium oxide ($ZrO_2$) and a secondary oxide or dopant (described below), and (2) alumina ($Al_2O_3$). The zirconia alloy comprises from about 50%, by weight, up to about 99.9% of the composite. Thus, the alumina can be present at from about 0.1 to about 50%, by weight. Preferably, the amount of zirconia alloy is from about 70 to about 90%, by weight, and more preferably it is from about 75 to about 85%, by weight, with the remainder being alumina.

The zirconia alloy contains zirconium oxide that is "doped" with a secondary oxide selected from the group consisting of MgO, CaO, $Y_2O_3$, $Sc_2O_3$, rare earth oxides (such as $Ce_2O_3$, $Nd_2O_3$ and $Pr_2O_3$), and combinations or mixtures of any of these secondary oxides. The preferred secondary oxide is $Y_2O_3$. Thus, a yttria doped zirconia-alumina composite ceramic is most preferred.

The molar ratio of secondary oxide (dopant) to zirconium oxide in the alloy preferably ranges from about 0.1:99.9 to about 25:75, and is more preferably from about 0.5:99.5 to about 5:95. The dopant is especially beneficial in promoting the transformation of the high temperature stable phase of zirconia oxide (particularly, the tetragonal phase) to the metastable state at room temperature. It also provides improved properties such as, for example, high strength, and enhanced fracture toughness, and resistance to wear, abrasion and corrosion.

The zirconia utilized in this invention can be of any crystalline form or phase including the tetragonal, monoclinic and cubic forms, or mixtures of two or more of such phases. The predominantly tetragonal form of zirconia is preferred because of its high fracture toughness, especially when the zirconia alloy comprises about 80% or more of the composite. By "predominantly" is meant from about 80 to 100% of the zirconia is of the tetragonal crystalline form. Methods for converting one form of zirconia to another are well known in the art.

The alumina in the composite is in the rhombhedral form or phase (this may be indexed as hexagonal by a crystallographer), and is known as $\alpha$-alumina Thus, a preferred composite comprises predominantly tetragonal zirconia doped with a secondary oxide (as noted above), in admixture with predominantly $\alpha$-alumina. Most preferably, this composite would comprise from about 80 to about 99.9% by weight of an alloy comprising 100% tetragonal zirconia doped with up to 3% (based on zirconium oxide weight) of yttria, in admixture from about 0.1 to about 20% (by weight) of 100% $\alpha$-alumina.

The zirconia-alumina composite ceramic utilized in this invention can be effectively converted from a hydrophilic to an oleophilic state by exposure to infrared radiation at a wavelength of about 1064 nm (or 1.064 $\mu$m). Radiation of this wavelength serves to convert a stoichiometric zirconium oxide that is strongly hydrophilic, to a substoichiometric zirconium oxide that is strongly oleophilic by promoting a reduction reaction. The use for this purpose of Nd:YAG lasers that emit at 1064 nm is especially preferred.

Conversion from an oleophilic to a hydrophilic state can be effectively achieved by exposure to visible radiation with a wavelength of 488 nm (or 0.488 $\mu$m). Radiation of this wavelength serves to convert the oleophilic substoichiometric zirconium oxide to the hydrophilic stoichiometric zirconium oxide by promoting an oxidation reaction. Argon lasers that emit at 488 nm are especially preferred for this purpose, but carbon dioxide lasers irradiating in the infrared (such as 10600 nm or 10.6 $\mu$m) are also useful.

While heating substoichiometric zirconia or zirconia alloys at from about 150° to about 250° C. can also convert the zirconium oxide to a stoichiometric state, the zirconium oxide of the zirconia-alumina composites described herein can be similarly converted at a higher temperature, for example from about 300° to about 500° C.

The printing members of this invention can be of any useful form including, but not limited to, printing plates, printing cylinders, printing sleeves, and printing tapes (including flexible printing webs).

Printing plates can be of any useful size and shape (for example, square or rectangular), and can be composed of the zirconia-alumina composite throughout (monolithic), or have a layer of the composite ceramic disposed on a suitable metal or polymeric substrate (with one or more optional intermediate layers). Such printing plates can be prepared using known methods including molding alloy powders into the desired shape (for example, isostatic, dry pressing or injection molding) and then sintering at suitable high temperatures, such as from about 1200° to about 1600° C. for a suitable time (1 to 3 hours). Alternatively, they can be prepared by thermal spray coating or vapor deposition of a zirconia-alumina mixture on a suitable semirigid or rigid substrate.

Printing cylinders and sleeves are described, for example, in the noted CIP application, U.S. Ser. No. 08/844,348 of Chatterjee, Ghosh and Nüssel. Such rotary printing members can be composed of the noted zirconia-alumina composite ceramic throughout, or the printing cylinder or sleeve can have the ceramic only as an outer layer on a substrate. Hollow or solid metal cores can be used as substrates if desired. Such printing members can be prepared using methods described above for the printing plates, as monolithic members or fitted around a metal core.

With regard to printing plates, printing cylinders and printing sleeves of this invention, the zirconia-alumina composite ceramic generally has very low porosity, that is less than about 0.1%, a density of from about 5.0 to about 6.05 g/cm$^3$ (preferably from about 5.0 to about 5.5, and more preferably from about 5.3 to about 5.4 g/cm$^3$ for preferred composites), and a grain size of from about 0.2 to about 1 $\mu$m (preferably from about 0.2 to about 0.8 $\mu$m). A useful thickness of the zirconia-alumina composite ceramic for such printing members would be readily apparent to one skilled in the art.

The zirconia-alumina composite ceramics useful in preparing printing tapes of this invention have a little more porosity, that is generally up to about 2%, and preferably from about 0.2 to about 2%. The density of the material is generally from about 5 to about 5.5 g/cm$^3$, and preferably from about 5 to about 5.2 g/cm$^3$ (for the preferred zirconia-yttria-alumina composite having 3 mol % yttria in the alloy). Generally, they have a grain size of from about 0.2 to about 1 $\mu$m, and preferably from about 0.2 to about 0.8 $\mu$m. The added porosity for printing tapes provides desired flexibility.

The ceramic printing tapes have an average thickness of from about 0.5 to about 5 mm, and preferably from about 1 to about 3 mm. A thickness of about 2 mm provides optimum flexibility and strength. The printing tapes can be formed either on a rigid or semi-rigid substrate to form a composite with the ceramic providing a printing surface, or they can be in monolithic form.

The printing tapes of this invention, in the form of a continuous web, enable a user to use different segments of the tape for different images. The tape would therefore provide continuity within the "same printing job" even if the images differed. The user need not interrupt the work to change conventional printing plates in order to provide different printed images.

The printing members of this invention can have a printing surface that is highly polished (as described below), or be textured using any conventional texturing method (chemical or mechanical). In addition, glass beads can be incorporated into the ceramic to provide a slightly textured or "matted" printing surface. Porosity of the printing members can be varied in a number of ways to enhance water distribution in printing, and to increase flexibility of the printing member where needed.

The methods for manufacturing zirconia-alumina composite ceramic articles consists of mixing desired amounts of high purity doped zirconia powder with high purity alumina powder (methods for making doped zirconia are described in U.S. Ser. No. 08/576,178, noted above), now U.S. Pat. No. 5,743,188, compacting the resulting composite powder mix using a suitable method known in the art (such as dry pressing, injection molding, or cold isostatic pressing), and sintering at a suitable temperature. The resolution of laser written images on zirconia composite ceramic surfaces depends not only on the size of the laser spot and its interaction with the material, but on the density and grain size of the zirconia-alumina composites. The zirconia-alumina composite ceramics described in the noted patents are especially effective for use in lithographic printing because of their high density and fine grain size. The density and porosity of the ceramic printing members can also be varied by adjusting their consolidation parameters, such as pressure and sintering temperature.

The printing members of this invention can be produced by techniques described above, as well as (for printing tapes) thermal or plasma spray coating on a flexible substrate, by physical vapor deposition (PVD) or chemical vapor deposition (CVD) of a zirconia-alumina composite on a suitable semirigid or rigid substrate. In the case of PVD or CVD, printing tapes can either be left on the substrate or they can be peeled off the substrate, or the substrate can be chemically dissolved away. Alternatively, ceramic printing tapes can be formed by conventional methods such as slip casting, tape casting, dip coating and sol-gel techniques.

Thermal or plasma spray and CVD and PVD processes can be carried out either in air or in an oxygen environment to produce hydrophilic non-imaged printing surfaces. Whereas if these processes are carried out in an inert atmosphere, such as in argon or nitrogen, the printing surfaces thus produced are oleophilic in nature. The printing tapes prepared by other conventional methods require sintering of the "green" tapes at a suitable high temperature (such as 1200° to 1600° C.) for a suitable time (1 to 3 hours), in air, oxygen or an inert atmosphere.

Tape casting is one convenient method for manufacturing the printing tapes (or webs) of this invention. Very thin, flexible "green" sheets of the composite ceramics described herein can be produced with high productivity using this continuous process of tape casting. In this process, initially a concentrated slurry containing deflocculated powders (of zirconia alloy and alumina) mixed with a relatively high concentration of binder, plasticizers and deflocculants is prepared. The tape is then formed when the slurry flows beneath a blade, forming a film on a moving carrier substrate, and is dried. Thin sheets of composite ceramic may also be formed by pouring the slurry onto a flat surface (or subtrate) and moving a blade over the surface to form the "green" tape. The dried "green" tape is rubbery and flexible and has a very smooth surface.

The dried "green" tapes can be removed from the substrate and cut into desired lengths. Finally, the tapes are sintered in a suitable environment at a predetermined temperature for a predetermined time (both conditions are dependent upon the types of composites and components).

Representative binders useful in tape casting include, but are not limited to, polyvinyl butyral, polymethyl methacrylate, polyvinyl alcohol, polyethylene, acrylics and methyl cellulose. Representative plasticizers include, but are not limited to, polyethylene glycol, butyl benzyl phthalate, glycerine and dibutyl phthalate. A useful deflocculant is menhaden fish oil, as well as synthetic materials such as Darvan C (available from R. T. Vanderbilt Corp.).

The printing surface of the zirconia-alumina composite ceramic can be thermally or mechanically polished, or it can be used in the "as sintered", "as coated", or "as sprayed" form, as described above. Preferably, the printing surface is polished to an average roughness of less than about 0.1 $\mu$m.

In one embodiment of this invention, a printing member is a solid or monolithic printing cylinder composed partially or wholly of the noted zirconia-alumina composite ceramic. If partially composed of the ceramic, at least the outer printing surface is so composed. A representative example of such a printing cylinder is shown in FIG. 1. Solid rotary printing cylinder 10 is composed of a zirconia-alumina composite ceramic throughout, and has outer printing surface 20.

Another embodiment, illustrated in FIG. 2, is rotary printing cylinder 30 having metal core 40 on which zirconia-alumina composite ceramic layer or shell 45 has been disposed or coated in a suitable manner to provide outer printing surface 50 composed of the ceramic. Alternatively, the zirconia-alumina composite ceramic layer or shell 45 can be hollow, cylinder printing sleeve or jacket (see FIG. 3) that is fitted around metal core 40. The cores of such printing members are generally composed of one or more metals, such as ferrous metals (iron or steel), nickel, brass, copper or magnesium. Steel cores are preferred. The metal cores can be hollow or solid throughout, or be comprised of more than one type of metal. The zirconia-alumina composite ceramic layers disposed on the noted cores generally have a uniform thickness of from about 1 to about 10 mm.

Still another embodiment is shown in FIG. 3 wherein hollow cylindrical zirconia-alumina composite sleeve 60 is composed entirely of the ceramic and has outer printing surface 70. Such sleeves can have a thickness within a wide range, but for most practical purposes, the thickness is from about 1 to about 10 cm.

Figure 5:
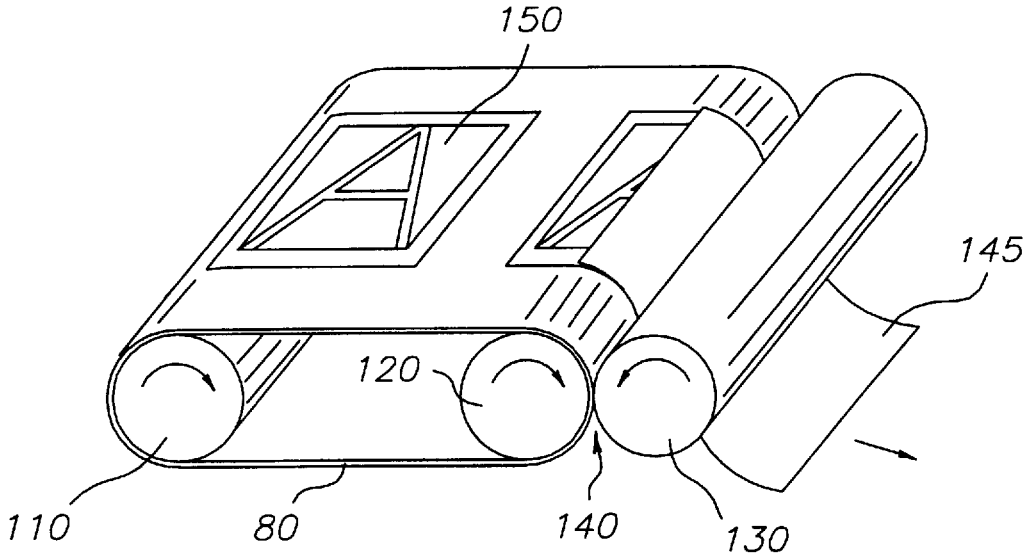
FIG. 5 is a highly schematic side view of a printing tape of this invention in a continuous web form, mounted on a set of rollers.

FIG. 4 illustrates one embodiment of a printing tape of this invention in a partial isometric view. Tape 80 is an elongated web 85 of zirconia-alumina composite ceramic that has printing surface 90, end 95 and edge 100 having a defined thickness (as described above). Such a web can be mounted on a suitable image setting machine or printing press, usually as supported by two or more rollers for use in imaging and/or printing. Thus, in a very simplified fashion, FIG. 5 schematically shows printing tape 80 supported by drive rollers 110 and 120. Drive roller 120 and backing roller 130 provide nip 140 through which paper sheet 145 or another printable substrate is passed after receiving the inked image 150 from tape 80. Such printing machines can also include laser imaging stations, inking stations, "erasing" stations, and other stations and components commonly used in lithographic printing.

Figure 6:
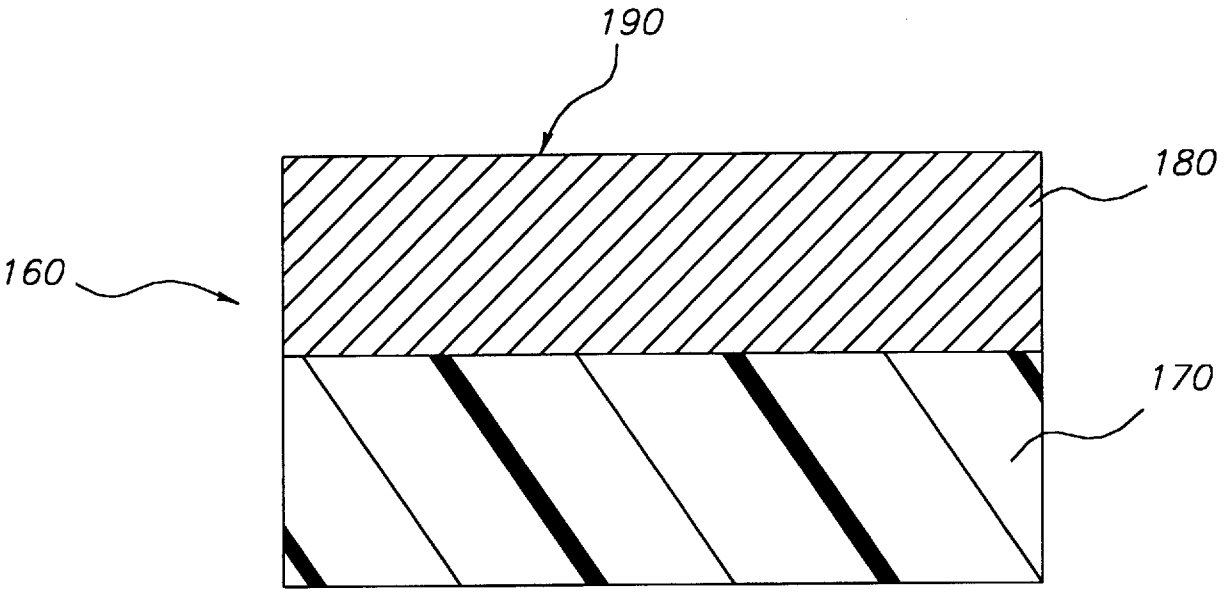
FIG. 6 is a highly enlarged cross-sectional view of a printing plate of this invention having a layer of a zirconia-alumina composite ceramic to provide a printing surface.

FIG. 6 shows one type of printing plate, that is printing plate 160 comprised of metal or polymeric (such as polyester) substrate 170 having thereon zirconia-alumina composite ceramic layer 180 providing printing surface 190.

The lithographic printing members of this invention can be imaged by any suitable technique on any suitable equipment, such as a plate setter or printing press. In one embodiment, the essential requirement is imagewise exposure to radiation which is effective to convert the hydrophilic zirconia-alumina composite ceramic to an oleophilic state or to convert the oleophilic zirconia-alumina composite ceramic to a hydrophilic state. Thus, the printing members can be imaged by exposure through a transparency or can be exposed from digital information such as by the use of a laser beam. Preferably, the printing members are directly laser written. The laser, equipped with a suitable control system, can be used to "write the image" or to "write the background."

Zirconia-alumina composite ceramics of stoichiometric composition are produced when sintering or thermal processing is carried out in air or an oxygen atmosphere. Zirconia-alumina composite ceramics of substoichiometric composition can be produced when sintering or thermal processing is carried out in an inert or reducing atmosphere, or by exposing them to electromagnetic irradiation.

The preferred zirconia-yttria-alumina composite ceramics comprising stoichiometric zirconia, are off-white in color and strongly hydrophilic. The action of the laser beam transforms the off-white ceramic to black substoichiometric ceramic that is strongly oleophilic. The off-white and black compositions exhibit different surface energies, thus enabling one region to be hydrophilic and the other oleophilic. The imaging of the printing surface is due to photo-assisted reduction while image erasure is due either to thermally-assisted reoxidation or to photo-assisted thermal reoxidation.

For imaging the zirconia-alumina composite ceramic printing surface, it is preferred to utilize a high-intensity laser beam with a power density at the printing surface of from about $30\times10^6$ to about $850\times10^6$ watts/cm$^2$ and more preferably from about $75\times10^6$ to about $425\times10^6$ watts/cm$^2$. However, any suitable exposure to electromagnetic radiation of an appropriate wavelength can be used.

An especially preferred laser for use in imaging the lithographic printing member of this invention is an Nd:YAG laser that is Q-switched and optically pumped with a krypton arc lamp. The wavelength of such a laser is 1.064 $\mu$m.

In one method of laser imaging, the conditions of laser exposure are controlled to provide localized "melting" of the exposed regions in the composite ceramic. Thus, these conditions of laser imaging effectively melt the zirconia in the printing surface in exposed regions. The laser imaging conditions for this method are described below.

In another method of laser imaging, the conditions of laser exposure are controlled to "ablate", burn away or loosen a portion of the composite ceramic in the exposed regions of the printing surface. Thus, if the layer of ceramic is thick enough, a pit is formed in the exposed regions from the removal of "ablated" composite ceramic. The bottom surface of the "pits" may actually comprise at least partially "melted" composite ceramic. If the composite ceramic layer is very thin, the ablation may remove it in the exposed regions down to an underlying substrate (such as a metal of polymeric support material). However, this situation is avoided by proper choice of composite ceramic layer thickness and laser irradiation conditions. The laser imaging conditions for this method are described below.

For use in the hydrophilic to oleophilic conversion process by means of ablation, the following parameters are characteristic of a laser system that is especially useful.

| | |
|---|---|
| Laser Power: | Continuous wave average - 0.1 to 50 watts, preferably from 0.5 to 30 watts, Peak power (Q-switched) - 6,000 to $10^5$ watts, preferably from 6,000 to 70,000 watts, Power density - $30 \times 10^6$ to $850 \times 10^6$ W/cm$^2$, preferably from $75 \times 10^6$ to $425 \times 10^6$ W/cm$^2$, |
| Spot size in $TEM_{00}$ mode = | 100 $\mu$m, |
| Current = | 15 to 24 amperes, preferably from 18 to 24 amperes, |
| Laser energy = | $6 \times 10^{-4}$ to $5.5 \times 10^{-3}$ J, preferably from $6 \times 10^{-4}$ to $3 \times 10^{-3}$ J, |
| Energy density = | 5 to 65 J/cm$^2$, preferably from 7 to 40 J/cm$^2$, |
| Pulse Rate = | 0.5 to 50 kHz, preferably from 1 to 30 kHz, |
| Pulse Width = | 50 to 300 nsec, preferably from 80 to 150 nsec, |
| Scan Field = | 11.5 × 11.5 cm, |
| Scan Velocity = | up to 3 m/sec, |
| Repeatability in pulse to pulse jitter = | about 25% at high Q-switch rate (about 30 kHz), <10% at low Q-switch rate (about 1 kHz). |

For imaging by means of "melting", essentially the laser set up conditions are basically the same as that of the ablation conditions noted above, however whether the laser will operate in the ablation mode or in the melting mode will be determined by the dot frequency in a given scan area. It is also characterized by very low Q-switch rate (<1 kHz), slow writing speed (scan velocity of 30 to 1000 mm/sec) and wide pulse width (50 to 500 $\mu$sec).

The laser images can be easily erased from the zirconia-alumina composite ceramic printing surface. The printing member is cleaned of printing ink in any suitable manner using known cleaning devices and procedures, and then the image is erased by either heating the surface in air or oxygen at an elevated temperature (temperatures of from about 300° to about 500° C. for a period of about 5 to about 60 minutes are generally suitable with a temperature of about 400° C. for a period of about 10 minutes being preferred) or by treating the surface with a $CO_2$ laser operating in accordance with the following parameters:

| | |
|---|---|
| Wave length: | 10.6 $\mu$m |
| Peak Power: | 300 watts (operated at 20% duty cycle) |
| Average Power: | 70 watts |

Beam Size: 500 $\mu$m with the beam width being pulse modulated.

In addition to its use as a means for erasing the image, a $CO_2$ laser can be employed as a means of carrying out the imagewise exposure in the process employing an oleophilic to hydrophilic conversion.

Only the printing surface of the zirconia-alumina composite ceramic is altered in the image-forming process. However, the image formed is a permanent image which can only be removed by means such as the thermally-activated or laser-assisted oxidation described herein.

Upon completion of a printing run, the printing surface of the printing member can be cleaned of ink in any suitable manner and then the image can be erased and the plate can be re-imaged and used again. This sequence of steps can be repeated many times as the printing member is extremely durable and long wearing.

In the examples provided below, the images were captured electronically with a digital flat bed scanner or a Kodak Photo CD. The captured images were converted to the appropriate dot density, in the range of from about 80 to about 250 dots/cm. These images were then reduced to two colors by dithering to half tones. A raster to vector conversion operation was then executed on the half-toned images. The converted vector files in the form of plot files were saved and were laser scanned onto the ceramic printing surface. The marking system accepts only vector coordinate instructions and these instructions are fed in the form of a plot file. The plot files are loaded directly into the scanner drive electronics. The electronically stored photographic images can be converted to a vector format using a number of commercially available software packages such as COREL DRIVE or ENVISION-IT by Envision Solutions Technology.

The invention is further illustrated by the following examples of various useful printing members.

EXAMPLE 1

Zirconia-alumina composite ceramic printing tapes of this invention were prepared by any one of the following thick or thin film forming processes, either on a flexible substrate or as a monolithic web. The tape forming processes include thermal or plasma spraying, physical vapor deposition (PVD), such as ion beam assisted sputtering, chemical vapor deposition (CVD), sol-gel film forming techniques, tape casting, dip coating and slip casting. The noted methods and the appropriate choice of precursors are well known in the art. In certain experimental procedures, the tapes were formed as continuous webs.

In one instance, plasma spray/thermal spray methods were used, employing a PLASMADYNE SG-100 torch. Spraying of a mixture of an alloy of zirconia and yttria (3 mol %), and $\alpha$-alumina (20% of total composite weight) was carried out on either 0.13 mm (5 mil) or 0.26 mm (10 mil) stainless steel substrates. The fine particle size distribution in the starting powders exhibited considerable improvement in the sprayed printing tape density. Prior to spraying, the substrates were sand blasted to improve adhesion of sprayed yttria doped zirconia-alumina composite. Coating with the PLASMADYNE SG-100 torch produced uniform coating thickness throughout the length and width of the resulting printing tape.

In another embodiment, a physical vapor deposition (PVD) method, more specifically ion-beam assisted sputtering, was used to prepare yttria doped zirconia-alumina composite ceramic printing tapes. Further details of such PVD procedures are provided in U.S. Pat. No. 5,075,537 (Hung et al) and U.S. Pat. No. 5,086,035 (Hung et al), incorporated herein by reference with respect to the zirconia ceramic layer preparations.

The resulting zirconia-alumina composite ceramic printing tapes were imaged using the procedure described in Example 2 below.

EXAMPLE 2

Images containing half-tones through continuous tones were formed on several typical zirconia-alumina composite ceramic printing tapes as described above. One surface of each printing tape was imaged by irradiation with a Nd:YAG laser. Imaging was carried out on an off-white hydrophilic surface. In another embodiment, the entire printing surface was exposed with a Nd:YAG laser that turned the printing surface black (oleophilic) in color. The Nd:YAG laser was Q-switched and optically pumped with a krypton arc lamp. The spot size or beam diameter was approximately 100 $\mu$m in TEM (low order mode). The black oleophilic printing surface was imaged at either 0.488 or 1.064 μm to provide hydrophilic images.

EXAMPLE 3

Several zirconia-alumina composite ceramic printing tapes of this invention were prepared in the form of continuous webs by the plasma spray process as described above. Such printing tapes were wrapped around two drive rollers in a conventional printing press, as illustrated in FIG. 5. These printing tapes were imaged as described above in Example 2.

EXAMPLE 4

A printing tape that was prepared and imaged as described in Example 2 above was used for printing in the following manner.

The imaged printing tape was cleaned with a fountain solution made up from Mitsubishi SLM-OD fountain concentrate. The concentrate was diluted with distilled water and isopropyl alcohol. Excess fluid was wiped away using a lint-free cotton pad. An oil-based black printing ink, Itek Mega Offset Ink, was applied to the printing tape by means of a hand roller. The ink selectively adhered to the imaged areas only. The image was transferred to plain paper by placing the paper over the plate and applying pressure to the paper.

EXAMPLE 5

The printing tape described and used in Example 4 above was cleaned of printing ink, "erased" and reused in the following manner.

After cleaning off printing ink as described in Example 4, the printing tape was exposed to high heat (about 400° C.) to erase the image. The printing tape was then reimaged, reinked and reused for printing as described in the previous examples.

EXAMPLE 6

Ceramic printing plates were prepared in the form of 80 mm×60 mm×1 mm thick sintered yttria doped zirconia-alumina composite ceramic sheets. The printing plates were imaged as described above in Example 2.

EXAMPLE 7

A zirconia-alumina composite ceramic cylinder or sleeve was prepared from highly dense zirconia-alumina composite ceramics in any of the following forms: as a monolithic drum or printing cylinder, as a printing shell mounted on a metallic drum or core, or as a hollow printing sleeve. Each of these three forms were prepared using a yttria doped zirconia-alumina composite, using one of the following manufacturing processes:

a) dry pressing to the desired or near-desired shape, b) cold isostatic pressing and green machining, and c) injection molding and de-binding.

After each of these processes, the printing member was then subjected to high temperature (about 1500° C.) sintering and final machining to the desired dimensions.

The printing shell and sleeve were also prepared by slip casting of a zirconia-alumina composite on a non-ceramic core, and then sintering. The shells were assembled on metallic cores either by shrink fitting or press fitting.

The printing cylinders and sleeves were imaged as described in Example 2 above.

EXAMPLE 8

A printing tape of this invention was prepared by tape casting using the following procedure:

Yttria-doped zirconia powder was thoroughly mixed with alumina powder (20% of total powder weight) to form the composite. About 80 weight % of composite powder was mixed with polyvinyl butyral binder (7 weight %), menhaden fish oil deflocculant (6 weight %), and butyl benzyl phthalate plasticizer (7 weight %). The resulting mixture was then knife blade coated onto a silicon coated Mylar film substrate to form a continuous composite web. After drying the web at room temperature, the substrate was removed from the "green" composite tape, which was then sintered at about 1500° C. for about 2 hours in air.

The resulting printing tape was imaged using an Nd:YAG laser, radiating at 1.064 μm. The imaged printing tape was then used in lithographic printing as described in Example 4 above.

The invention has been described in detail, with particular reference to certain preferred embodiments thereof, but it should be understood that variations and modifications can be effected within the spirit and scope of the invention.

We claim:

1. A lithographic printing member having a printing surface composed of a ceramic that is a composite of: (1) a zirconia alloy, and (2) alumina, said composite ceramic having a density of from about 5.0 to 6.05 g/cm$^3$ and from about 0.1 to about 50%, by weight being composed of alumina, wherein said zirconia alloy is from about 80 to 100% in the tetragonal form.

2. The lithographic printing member of claim 1 wherein said composite ceramic comprises from about 10 to about 30%, by weight of α-alumina.

3. The lithographic printing member of claim 2 wherein said composite ceramic comprises from about 15 to about 25%, by weight of α-alumina.

4. The lithographic printing member of claim 1 having a polished printing surface.

5. The lithographic printing member of claim 1 wherein said zirconia alloy comprises a secondary oxide selected from the group consisting of MgO, CaO, $Y_2O_3$, $Sc_2O_3$, a rare earth oxide, and a combination of any of these.

6. The lithographic printing member of claim 5 wherein the molar ratio of said secondary oxide to said zirconia is from about 0.1:99.9 to about 25:75.

7. The lithographic printing member of claim 1 wherein said ceramic composite is composed of an admixture of a zirconia-yttria alloy and α-alumina.

8. The lithographic printing member of claim 7 wherein the molar ratio of yttria to zirconia is from about 0.5:99.5 to about 5.0:95.0, and said zirconia is 100% in the tetragonal form.

9. The lithographic printing member of claim 1 that is a printing plate, printing cylinder or a printing sleeve composed of said zirconia alloy-alumina composite ceramic having a density of from about 5.0 to about 5.5 g/cm$^3$, a grain size of from about 0.2 to about 1 mm and a porosity of less than about 0.1%.

10. The lithographic printing member of claim 1 that is a printing tape having a density of from about 5 to about 5.2 g/cm$^3$, a grain size of from about 0.2 to about 1 mm, an average thickness of from about 0.5 to about 5 mm, and a porosity of up to 2%.

11. The lithographic printing member of claim 1 wherein said zirconia alloy-alumina composite ceramic is composed of a hydrophilic stoichiometric zirconia alloy.

12. The lithographic printing member of claim 1 wherein said zirconia alloy-alumina composite ceramic is composed of an oleophilic substoichiometric zirconia alloy.

13. The lithographic printing member of claim 1 that is a lithographic printing plate having a non-ceramic substrate having thereon said zirconia alloy-alumina composite ceramic printing surface.

14. The lithographic printing member of claim 1 that is a lithographic printing plate that is composed of said composite ceramic throughout.

15. The lithographic printing member of claim 1 that is a lithographic printing cylinder.

16. The lithographic printing member of claim 1 that is a hollow lithographic printing sleeve.

17. The lithographic printing member of claim 16 that is mounted on a metal core.

* * * * *